US005265551A

United States Patent [19]

Rosenblad

[11] Patent Number: 5,265,551

[45] Date of Patent: Nov. 30, 1993

[54] EMERGENCY BILGE PUMP FOR SMALL BOATS

[76] Inventor: Axel E. Rosenblad, 77 Bayside Dr., Atlantic Highlands, N.J. 07716

[21] Appl. No.: 941,910

[22] Filed: Sep. 8, 1992

[51] Int. Cl.[5] ..... B63B 13/00

[52] U.S. Cl. ..... 114/183 R; 417/236

[58] Field of Search ..... 114/183 R, 184; 440/67, 440/900; 416/179, 159; 415/198.1, 198.3, 213.1, 214.1, 223, 226–228, 214.1, 182.1; 417/231, 236–238, 364

[56] References Cited

U.S. PATENT DOCUMENTS

| | | | |
|---|---|---|---|
| 1,663,253 | 3/1928 | Hillborn | 417/236 |
| 2,979,011 | 4/1961 | Mattson | 114/183 R |
| 3,289,592 | 12/1966 | Franzreb | 114/183 R |
| 3,584,463 | 6/1971 | Hansen | 417/236 |
| 4,046,097 | 9/1977 | Hornung | 440/67 |
| 4,681,057 | 7/1987 | Girag | 114/183 R |
| 4,688,987 | 8/1987 | Ericson | 415/182.1 |
| 5,018,470 | 5/1991 | Mitchell | 114/183 R |

*Primary Examiner*—Robert J. Oberleitner
*Assistant Examiner*—Clifford T. Bartz
*Attorney, Agent, or Firm*—Brooks Haidt Haffner & Delahunty

[57] ABSTRACT

A high capacity emergency bilge pump employs an inclined axial flow propeller in a tubular casing for discharging bilge water to a body of receiving water at a level submerged below the surface of the body of receiving water. The propeller of the bilge pump is driven by an outboard motor.

9 Claims, 4 Drawing Sheets

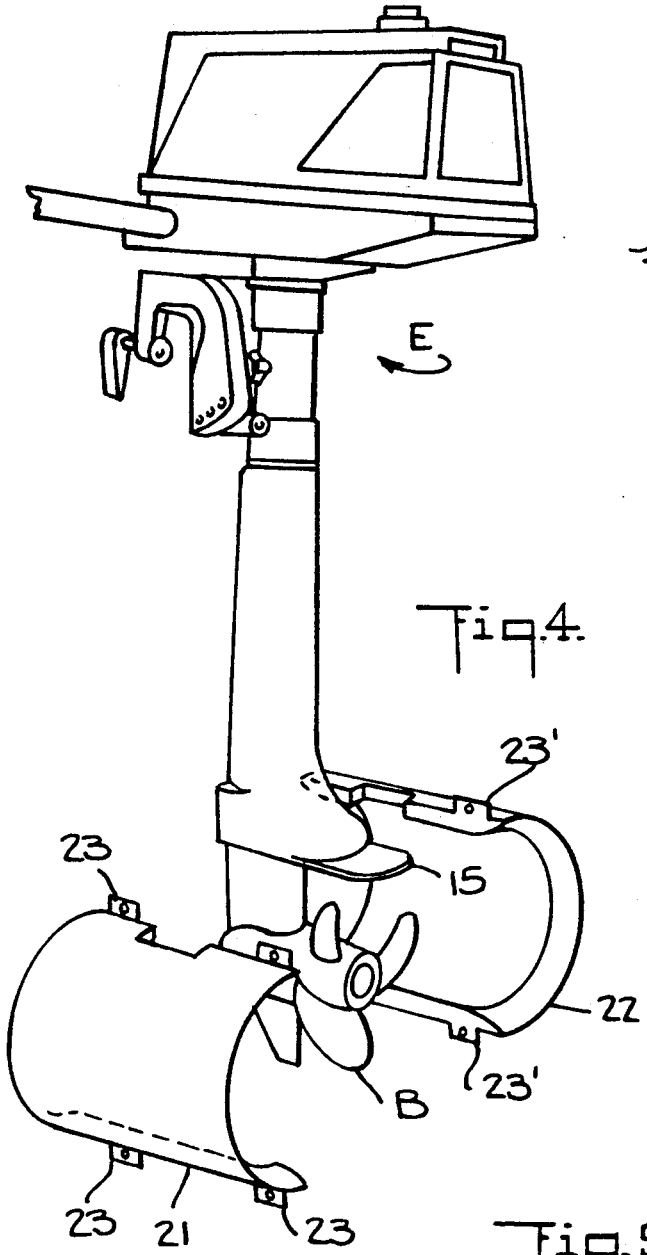
Fig. 7.
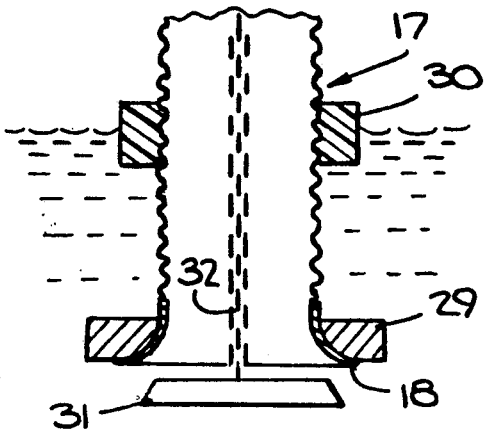
Fig. 4.
Fig. 6.
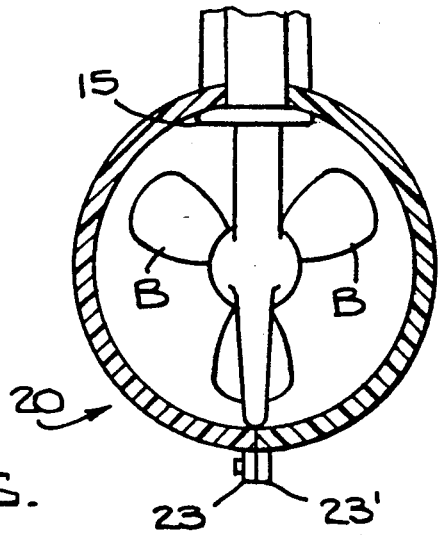
Fig. 5.
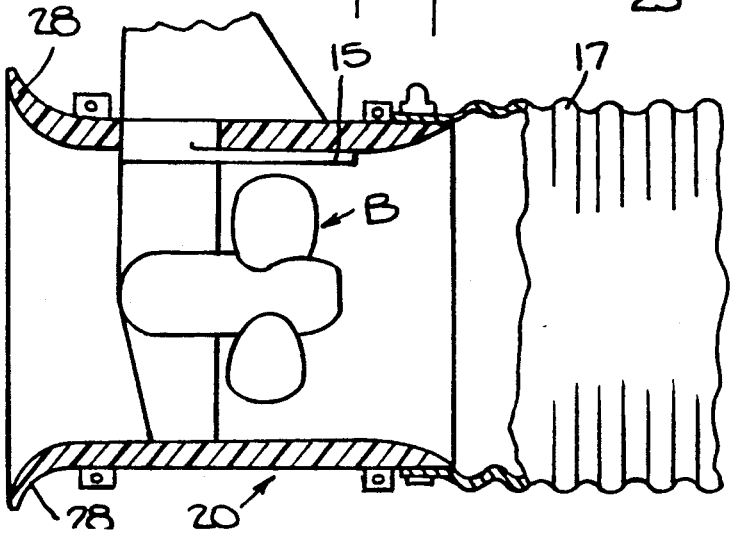

EMERGENCY BILGE PUMP FOR SMALL BOATS

BACKGROUND OF THE INVENTION

1. Field of the Invention

The invention relates to bilge pumps for small boats and to a device for converting a small outboard engine for emergency use as a bilge pump.

2. Description of the Prior Art

Small boat bilge pumps are typically positive displacement pumps or centrifugal pumps. Such essentially high head, low flow pumps are not ideally suited for use as bilge pumps.

When a boat is sinking there is only a small difference between the level of water outside the boat and the level of water inside the boat hull which has to be pumped out. In such an emergency the ability to get the water out of the boat rapidly is what really matters. What is desired is a large flow low head pump rather than the high head low flow pumps now commonly in use.

SUMMARY OF THE INVENTION

A small outboard engine, such as the engine used to power a dinghy, can be converted into a propeller pump that is very well suited for use as an emergency bilge pump. Even a small outboard engine can provide a far greater pumping capacity than the typical bilge pump.

The term "outboard engine" or "outboard motor" as used in this application has its ordinary meaning—a unit assembly of engine, propeller, and vertical drive shaft used to propel a boat and usually clamped to the boat transom; the power of various models ranges from 1 horsepower (approximately 750 watts) to well over 50 horsepower. This terminology is not meant to exclude an outboard engine when such an engine is installed within a boat or on the deck of a boat.

A typical small (5 HP) outboard engine has a three-blade propeller. When rotated, the tips of the propeller blades can define a circle having a diameter of about 9 inches. The aft surface or face of the propeller blade is commonly constructed as a true helical surface of constant pitch. When such a propeller is employed in accordance with the present invention, the pump which results can be considered an in line axial flow pump.

The particular model or design of the outboard engine adapted for use as an emergency pump in accordance with the invention is not critical. The structure and dimensions of a wide variety of propeller sizes, pitches, etc., can be accommodated in accordance with the invention. When used in a closed circuit bilge pumping system in accordance with the invention, an outboard engine acts as a high capacity pump.

Because of the high pumping capacity, even a fairly large boat with serious hull damage can be kept afloat by the use of the emergency bilge pump of the present invention.

The presently available high head, low flow bilge pumps typically range in advertised capacity from 500 to 2000 gallons per hour (GPH), but they operate at those capacities only under ideal operating conditions. A small outboard engine converted to use as a pump in accordance with the present invention will provide a much greater capacity than those conventional bilge pumps. The following table shows the pumping capacities of small outboard engines converted for use as pumps in accordance with the invention.

TABLE 1

| horsepower (HP) | gallons per minute (GPM) | gallons per hour (GPH) |
|---|---|---|
| 3.5 | 1,400 | 84,000 |
| 5.0 | 2,000 | 120,000 |
| 7.5 | 3,000 | 180,000 |
| 10 | 4,000 | 240,000 |
| 15 | 6,000 | 360,000 |

The use of such high capacity emergency bilge pumps permits keeping afloat or salvage even of boats of substantial size when they are leaking seriously. The following table relates the size of a hole in a boat hull, the depth of the hole below the water line (WL), and the pumping capacity needed, to handle the volume of water entering the boat.

TABLE 2

Diameters of holes, in inches, and at various depths below water line, which can be survived by using emergency bilge pumps of different capacities:

| GPM | 1,400 | 2,000 | 3,000 | 4,000 | 6,000 |
|---|---|---|---|---|---|
| 4 ft below WL | 7.6" | 9.1" | 11.2" | 12.9" | 15.8" |
| 3 ft below WL | 8.2" | 9.8" | 12.0" | 13.8" | 17.0" |
| 2 ft below WL | 9.1" | 10.9" | 13.3" | 15.3" | 18.8" |

Such serious damage is too great to cope with by use of a conventional bilge pump. For example, a 2,000 GPH (33 GPM) bilge pump can only deal with a 1.4 inch diameter hole at 2 feet below the water line, or with a 1.1 inch diameter hole 4 feet below the water line.

A typical 50 foot boat has a volume of about 18,000 gallons, and will sink in about three minutes with an 18 inch diameter hole in its hull. A 15 horsepower outboard engine employed as an emergency pump in accordance with the present invention could keep such a seriously damaged boat afloat.

In accordance with the invention a generally cylindrical casing fits closely around the propeller of the engine. Operation of the engine pumps bilge water through the casing and through a conduit attached to the casing and out of the hull. The casing can be formed of two or more sections which can be secured together in place around the engine propeller.

The emergency bilge pump can be employed within the boat hull or on the deck of the boat. Various applications of the bilge pump of the invention will be more fully understood when the following detailed description is read with reference to the accompanying drawing figures.

BRIEF DESCRIPTION OF THE DRAWINGS

In the several figures of the drawings, in which like reference numerals designate like parts throughout:

FIG. 4 is an exploded view similar to that of FIG. 1, showing a different two-part casing structure.

FIG. 5 is a sectional view illustrating a venturi inlet for a pump according to the invention.

FIG. 6 is a view in section taken along the axis of the pump of FIG. 4.

FIG. 7 shows an outlet for a pump conduit according to the invention.

DETAILED DESCRIPTION OF PREFERRED EMBODIMENTS

Figure 1:
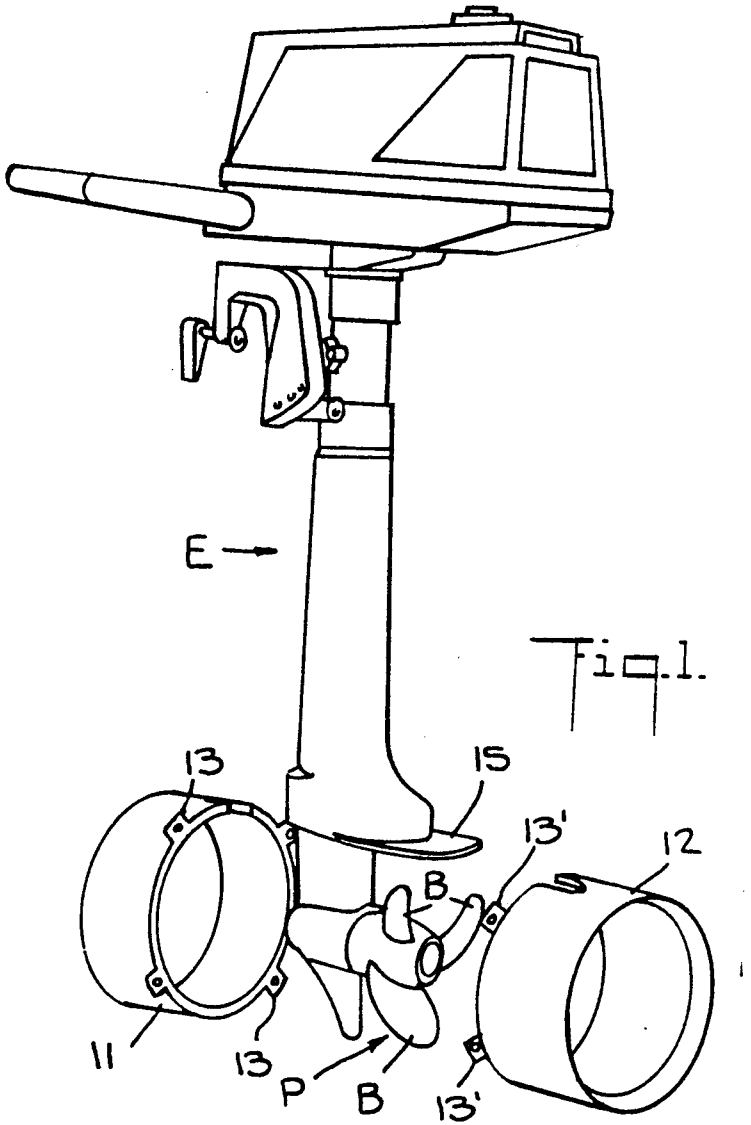
FIG. 1 is an exploded view of an outboard engine and a two-part casing for converting the engine into a pump.

FIG. 1 shows a typical small outboard engine E of the kind ordinarily used to power a dinghy or rowboat. The engine E is meant simply to be illustrative of the kind of outboard engine which can be employed as an emergency bilge pump in accordance with the present invention. The operation of the engine E will be fully understood by those acquainted with the field and needs no detailed explanation. The engine E is shown as having a conventional three-blade propeller P.

The casing parts 11 and 12 have lugs or ears 13, 13', respectively, projecting radially outward for interconnection by means of bolts when the parts 11 and 12 are in place about the engine propeller P. In the embodiment illustrated in FIG. 1, the casing part 11 has four such lugs 13 at its inner end and the part 12 has four lugs 13' arranged at its inner end to lie face to face with the lugs 13 of the part 11 for interconnection by means of bolts and nuts (not shown in FIG. 1). A smaller or larger number of lugs could of course be employed, or some other form of attachment for the two parts 11 and 12 could be used.

Figure 3:
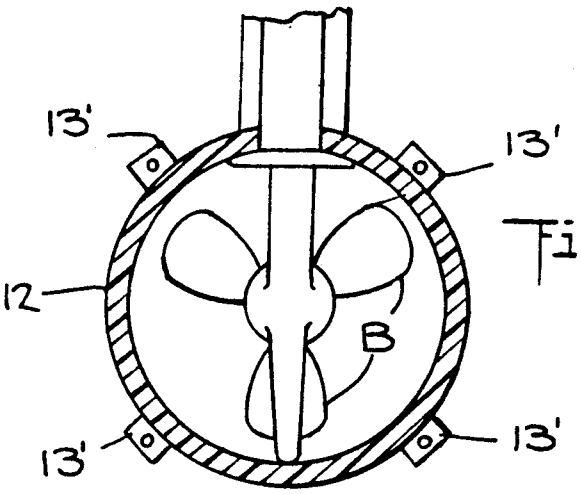
FIG. 3 is a view in section taken along the axis of a pump of the invention.

The casing part 12 fits outside the anti-cavitation plate 15 of the engine E or has slots 14 for fitting about the anti-cavitation plate 15 as shown in FIG. 3. FIG. 3 also shows that the internal diameter of the casing 10 is sized to be only slightly larger than the diameter of the circle defined by the blades B of the propeller P. The radial clearance between the blades B and the inner wall of the casing 10 is preferably as small as possible for most efficient pumping operation.

Figure 2:
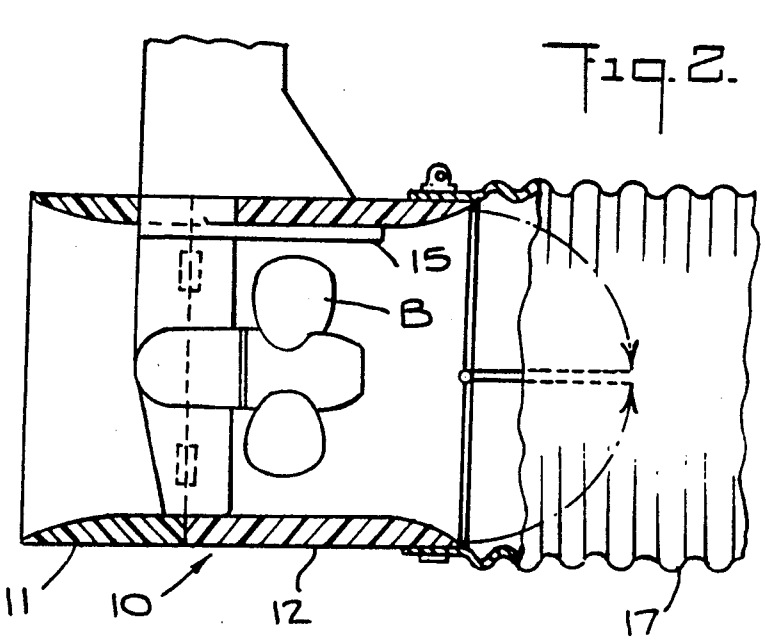
FIG. 2 is a view in section showing a pump of the invention.

The section view of FIG. 2 shows the casing 10 connected to a conduit 17, which can be of flexible material for convenience of storage when the emergency pump is not in use. When the pump is needed, the casing 10 can be secured about the engine's propeller P and the conduit 17 can be attached at the downstream side of the pump as shown in FIG. 2 by means of suitable fasteners such as screws. Upon operation water flows through the casing 10 under the pumping action of the propeller P and exits through the conduit 17, the other end of which conduit is outside the boat. A simple check valve V can be installed at the outlet end of the casing 10 as shown in FIG. 2.

The casing 10 is formed of rigid material, which can be fiber reinforced plastic material or metal. The conduit 17 can be a flexible hose made, for example, of metal with a rubber or plastic lining or made entirely of plastic material.

Most outboard engines are water-cooled and have an inlet for cooling water located near the propeller. If this is the case, the bilge water being pumped can serve as the cooling water.

FIGS. 4–6 illustrate another embodiment of the invention. The casing 20 of the embodiment shown in FIGS. 4–6 is divided longitudinally into two parts 21 and 22 which are provided with radially extending lugs 23 and 23' respectively along their opposed inner edges for interconnection by means such as bolts and nuts or screws. As in the case of the embodiment of FIGS. 1–3, some other means of fastening the parts of the casing 20 could be employed. The casing 20 is structured to fit about the anti-cavitation plate 15 of the engine E as shown in FIG. 6. As shown in FIG. 6, the casing 20 can be attached to a conduit 17 downstream of the propeller for operation as described with respect to FIGS. 1–3.

FIG. 5 also illustrates a modification of the casing 20 for applications which bilge water to be pumped out enters directly into the casing 20. In such applications it is desirable to provide a venturi inlet by forming the upstream ends of the casing parts 21, 22 with a smoothly outwardly widening mouth portion or lip 28. Such a venturi enhances pumping efficiency.

The casing 10 of FIGS. 1–3 can, of course, also be formed with a venturi at the upstream end of the casing part 11.

FIG. 7 shows the discharge end of the conduit 17 for discharging bilge water to the body of receiving water outside the boat. The discharge must be submerged below the water surface to minimize the static pump head. FIG. 7 shows how this submergence of the discharge end of conduit 17 can be achieved by providing a generally annular weight 29 encircling a widened, generally bell-shaped end 18 of the conduit 17, and an annular float 30 spaced an appropriate distance from the weight 29 to keep the conduit end 18 at the desired distance below the water level. Both the float 30 and the weight 29 can comprise two or more arcuate sections which can be secured together around the conduit 17.

Figure 8:
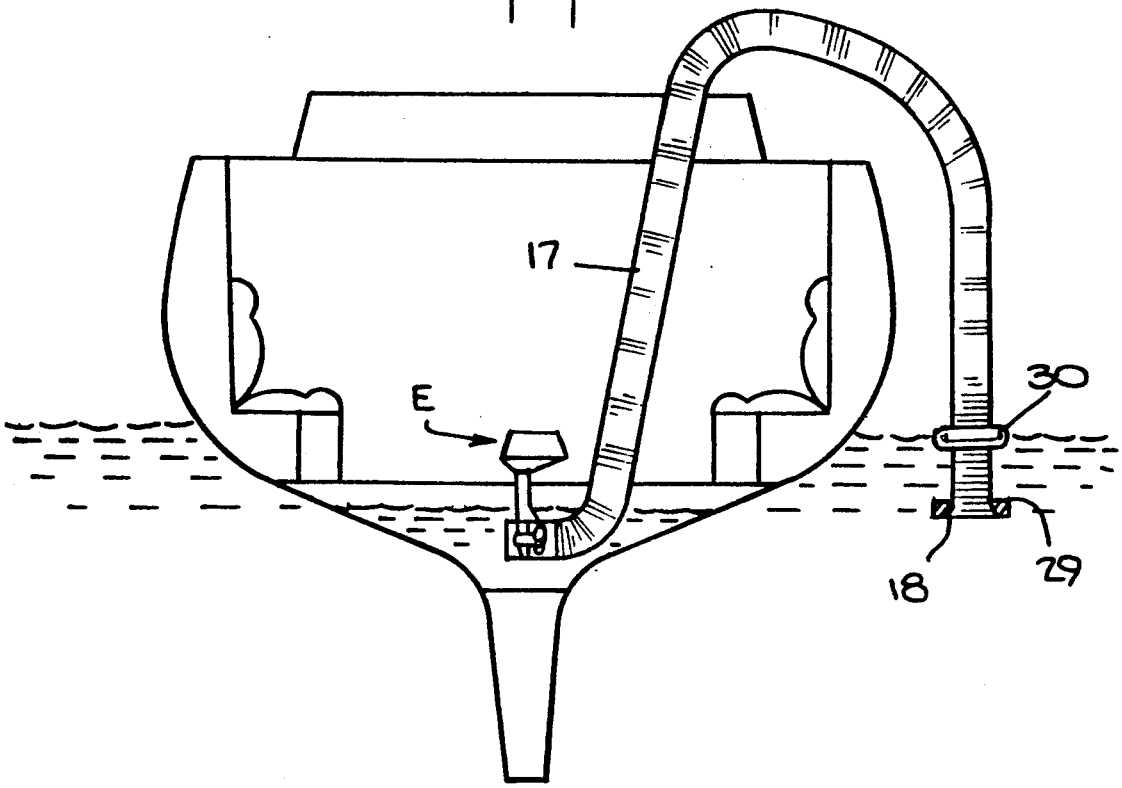
FIG. 8 is a schematic sectional view through a boat with the bilge pump of the invention positioned in the lowermost part of a boat hull or bilge.
Figure 9:
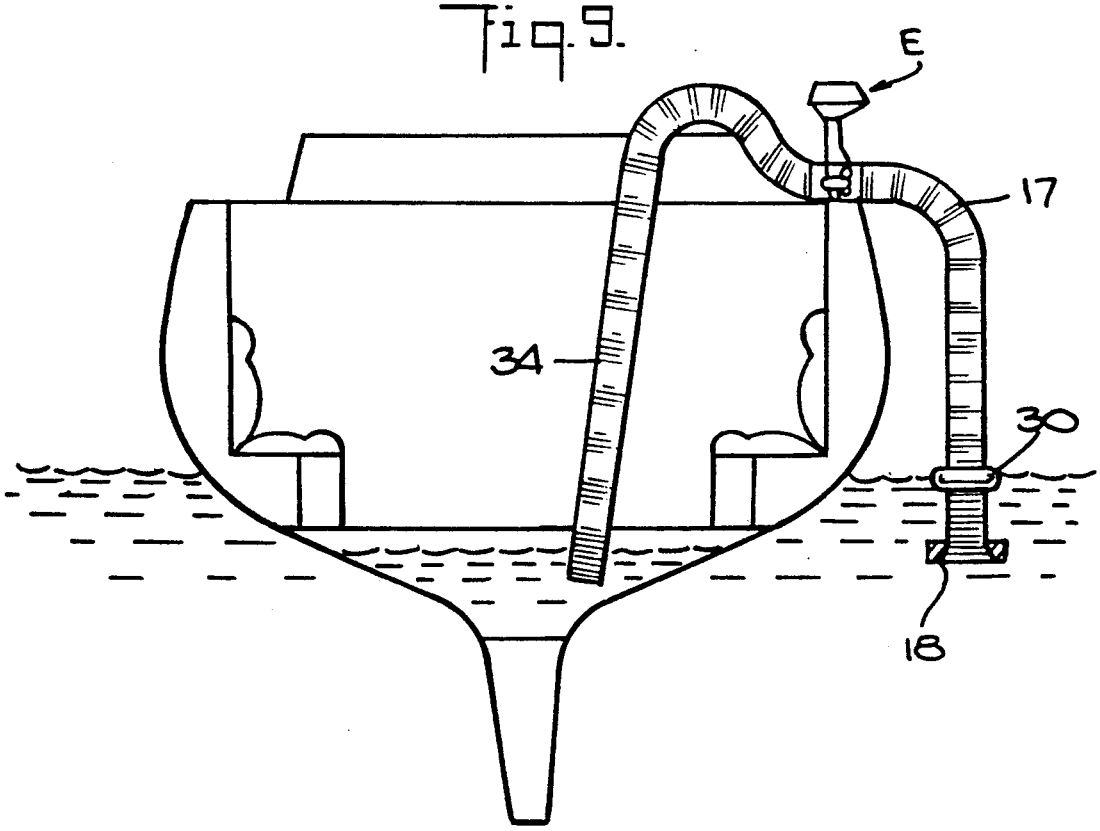
FIG. 9 is a view similar to that of FIG. 8 with the pump located on the deck of the vessel.

FIG. 7 also illustrates a simple check valve arrangement that can be employed at the end 18 of the conduit 17. A disc-shaped plate 31 attached at its center to a rope or chain 32 can be pulled upward to close the mouth 18 of the conduit 17, when priming the pump of the invention, in cases where such priming is required. Once the pump has been primed, the plate 31 can be lowered to open the valve. FIGS. 8 and 9 schematically illustrate that the static head is only the difference between the water levels inside and outside the boat.

FIG. 8 shows the bilge pump of the invention situated near a lowermost location within a schematically illustrated cross-sectional view of a representative sail boat. The illustration is approximately to scale if the boat is a 50 foot cutter and the engine E is a 5 horsepower outboard motor. When the emergency bilge pump of the invention is employed as shown in FIG. 8 no priming is needed because the pump is submerged. The conduit 17 conveys the water being pumped up out of the boat hull, over the side, and down to be discharged at the conduit mouth 18.

The emergency bilge pump of the invention can also be installed on the boat's deck as shown in FIG. 9. There are advantages in having the pump outside the hull, such as ease of installation and operation. One disadvantage of the application shown in FIG. 9 is the need to prime the pump before water can be discharged. Such priming can be done with a manual pump. As can be seen, when the pump of the invention is employed as in FIG. 9, an inlet conduit 34 must be attached to the upstream end of the casing 10 or 20 in addition to the outlet conduit 17 attached at the downstream end of the casing 10 or 20. In priming the pump in the exemplary case of a 50 foot sailboat, the total length of the conduits 34 and 17 plus the length of the casing would be on the order of 30 feet. If the conduits 34 and 17 are formed of 10 inch diameter flexible nose, about 120 gallons of water will be required to fill the hose and so prime the pump. A manual pump, such as a diaphragm pump available from Edison International with a nominal capacity of 30 gallons per minute, can be used to fill the conduits 34 and 17 quite rapidly.

Figure 10:
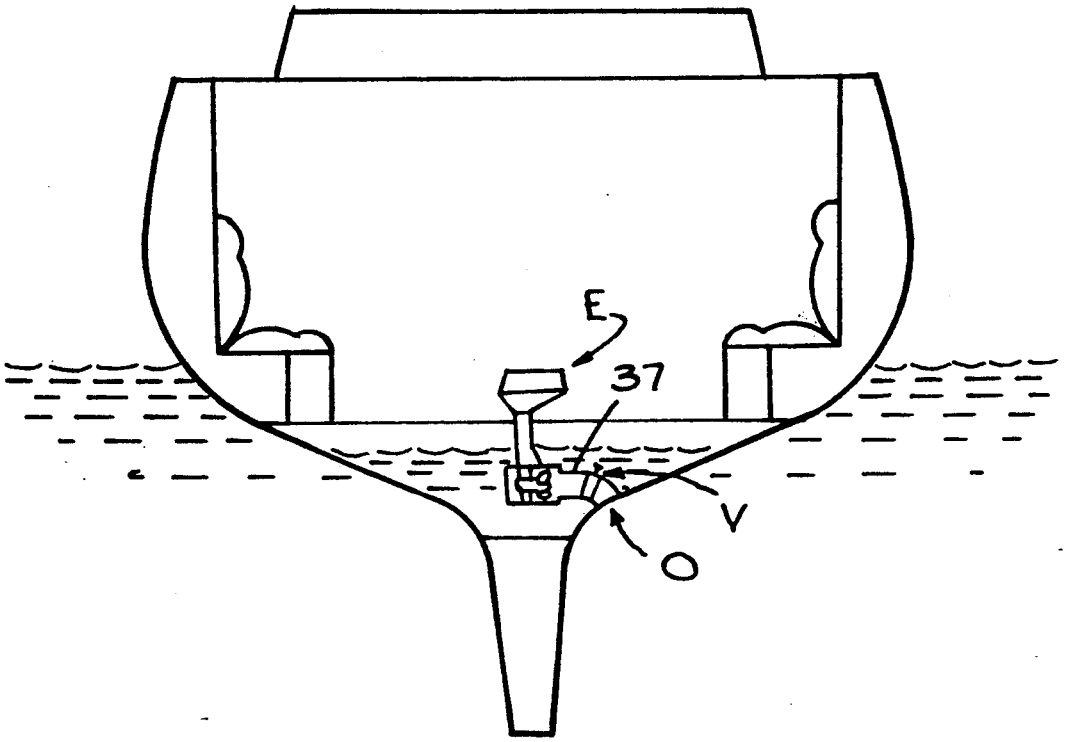
FIG. 10 shows another application of the pump of the invention in a case where there is a port through the hull of the boat.

The application shown in FIG. 10 is similar to that of FIG. 6 in that the pump is installed in the bilge, and no priming is required. In the application shown in FIG. 10 there is a normally closed opening O through the boat hull near the lowermost part of the hull through which the emergency bilge pump of the invention can discharge bilge water. The casing 10 or 20 is shown connected to the opening O by a discharge conduit 37 which is much shorter than the conduit 17 shown in FIGS. 8 and 9. The conduit 37 need not be a flexible hose, but can be a rigid pipe preferably equipped with a shut-off valve V. The pressure drop is minimized in the installation illustrated in FIG. 10, greatly increasing the pumping capacity of any given size outboard engine.

Figure 11:
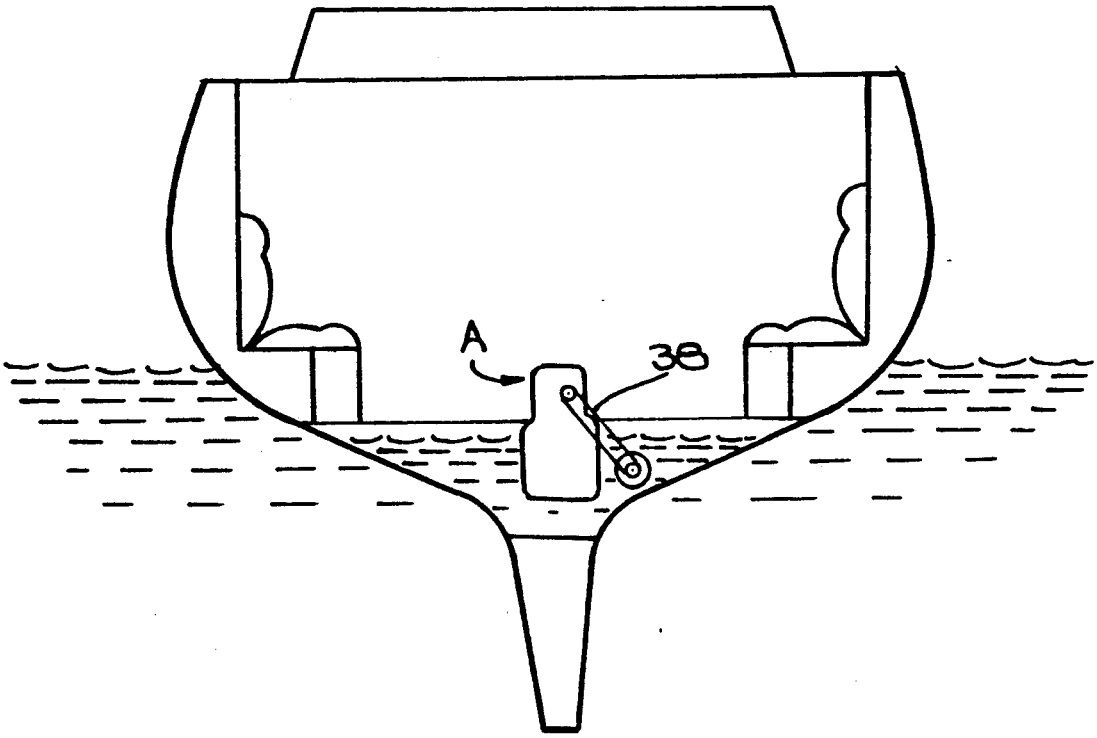
FIG. 11 shows an arrangement for driving an axial flow propeller pump with a belt driven attachment to an auxiliary boat engine.

The installation of FIG. 11 is similar to that of FIG. 10 for use in a boat with a normally closed through-hole in the boat hull. FIG. 11 schematically illustrates driving of a propeller pump by means of a belt drive off the auxiliary engine A of the sailboat. The belt is indicated by reference numeral 38. The through-hole is not shown in FIG. 11 since it is not necessarily located adjacent the auxiliary engine A but can be fore or aft with respect to the engine A. The propeller pump used in the embodiment of FIG. 11 can be either of the casings 10 or 20 described above or it can e a casing of one-piece construction.

although several presently preferred embodiments and applications of the emergency bilge pump of the invention have been described and shown, numerous other modifications and applications will suggest themselves to those acquainted with the art. What is described is an emergency, large flow pump.

I claim:

1. A bilge pump for small boats comprising a propeller and an outboard engine having a vertical drive shaft for driving the propeller, the propeller being mounted within a generally tubular casing comprising two symmetrical casing parts and means for joining the casing parts together to surround the propeller said pump acting as an inclined axial flow pump for discharging bilge water to a location beneath the surface of a body of receiving water.

2. A pump according to claim 1 wherein casing has a smoothly widening mouth at an upstream casing end where water enters the casing for enhancing pumping efficiency.

3. A pump in accordance with claim 1 or 2 and including a water discharge conduit attached to the casing downstream of the propeller.

4. A pump in accordance with claim 3 and including a check valve for the discharge conduit.

5. A pump in accordance with claim 4 wherein the check valve is adapted to be closed manually.

6. A pump in accordance with claim 3 wherein a free end of the discharge conduit is weighted to keep the free end submerged in a body of receiving water, and including a float on said conduit spaced from said free end to fix the extent of submergence of said free end.

7. A bilge pump in accordance with claim 1 or 2 wherein said casing comprises two generally tubular parts mounted end to end.

8. A bilge pump in accordance with claim 1 or 2 wherein said casing comprises two interconnected generally half-tubular parts.

9. A bilge pump in accordance with claim 1 or 2 and including a flexible hose connected at a downstream end of the casing and a flexible hose connected at an upstream end of the casing.

* * * * *

UNITED STATES PATENT AND TRADEMARK OFFICE

CERTIFICATE OF CORRECTION

PATENT NO. : 5,265,551
DATED : Nov. 30, 1993
INVENTOR(S) : Axel E. Rosenblad

It is certified that error appears in the above-indentified patent and that said Letters Patent is hereby corrected as shown below:

Column 5, line 37 "can e"
should read
--can be--.

Column 5, line 39, "although"
should read
--Although--.

Signed and Sealed this

Third Day of May, 1994

Bruce Lehman

*Attest:*

BRUCE LEHMAN

*Attesting Officer*

*Commissioner of Patents and Trademarks*